US005518412A

United States Patent [19]

Larabell

[11] Patent Number: 5,518,412

[45] Date of Patent: May 21, 1996

[54] GEARED BRACKET AND SLIDE ASSEMBLY

[76] Inventor: Henri J. Larabell, 10241 Rancho Place #A, Cupertino, Calif. 95104

[21] Appl. No.: 272,702

[22] Filed: Jul. 7, 1994

[51] Int. Cl.[6] ..... H01R 13/62

[52] U.S. Cl. ..... 439/157; 439/153

[58] Field of Search ..... 439/152–160, 439/372

[56] References Cited

U.S. PATENT DOCUMENTS

| | | | |
|---|---|---|---|
| 2,897,033 | 7/1959 | Ford | 312/20 |
| 3,488,622 | 1/1970 | Gley | 339/45 |
| 3,784,954 | 1/1974 | Grimm et al. | 339/17 LM |
| 4,071,722 | 1/1978 | Hart | 200/50 A |
| 4,614,389 | 9/1986 | Albert et al. | 339/45 |
| 4,717,982 | 1/1988 | Toreson et al. | 360/137 |
| 4,931,907 | 6/1990 | Robinson et al. | 361/391 |
| 4,941,841 | 7/1990 | Darden et al. | 439/377 |
| 4,960,384 | 10/1990 | Singer et al. | 439/155 |
| 4,982,303 | 1/1991 | Krenz | 360/137 |
| 5,003,431 | 3/1991 | Imsdahl | 361/415 |
| 5,010,426 | 4/1991 | Krenz | 360/971 |
| 5,035,634 | 7/1991 | Hasircoglu | 439/157 |
| 5,045,960 | 9/1991 | Eding | 369/97.01 |
| 5,110,301 | 5/1992 | Inoue et al. | 439/157 |
| 5,135,410 | 8/1992 | Kawase et al | 439/372 |
| 5,145,389 | 9/1992 | Okubo | 439/159 |
| 5,155,662 | 10/1992 | I-Shou | 361/392 |
| 5,269,698 | 12/1993 | Singer | 439/157 |
| 5,275,573 | 1/1994 | McCleerey | 439/153 |
| 5,281,157 | 1/1994 | Abe et al. | 439/159 |
| 5,299,944 | 4/1994 | Larabell et al. | 439/157 |
| 5,384,686 | 1/1995 | Mesfin et al. | 439/159 |

*Primary Examiner*—David L. Pirlot

[57] ABSTRACT

Disclosed herein is a bracket assembly for interconnecting electronic components. The bracket assembly includes a cam mounted on a carrier. The cam includes a cam hook which engages the pin of an equipment slide. When the cam rotates, the bracket assembly is drawn together with the equipment slide. A cam lever mounts on the carrier and actuates the cam.

15 Claims, 7 Drawing Sheets

GEARED BRACKET AND SLIDE ASSEMBLY

RELATED APPLICATION

This application is related in subject matter to U.S. Pat. No. 5,299,944, issue date Apr. 5, 1994, entitled "Universal Bracket and Assembly Slide for Storage Devices". This application is also related to U.S. application Ser. No. 08/157,675, filed Nov. 24, 1993, entitled "Universal Slide Mounted Adapter for Storage Devices," which is a continuation-in-part of the above-cited application.

BACKGROUND OF THE INVENTION

1. Field of the Invention

This invention relates to bracket assemblies which interconnect memory storage devices with a computer. More particularly, this invention relates to bracket assemblies which include a center pull cam.

2. Previous Art

The demand for computers continues to increase. Faster processing speeds, larger random memories and larger data storage capacities are desired. During the past decade, the computer industry has seen changes in data storage technology. Increases in data storage capacity is a characteristic of floppy disks, hard disks and optical disks. With increases in data storage capacity, great value has been placed on the exchange of memory between computers. Typically, memory exchange has been accomplished by exchanging disks, or by direct electronic links between computers.

Presently, computer hard disks have capacities of 2 gigabytes (GB) or more. The ability to exchange such large amounts of data between separated, stand-alone computer systems is desirable. Unfortunately, transferring such large amounts of data from one computer to another computer could require the exchange of a multitude of floppy disks, or removal and exchange hard disk drives, for example. Much time and effort could be consumed in this process. Accordingly, a more efficient way of transferring data from one computer to another is desired.

In various computer systems, the concept of "hot swapping" of storage devices has been introduced. "Hot swapping" allows a memory storage device, typically a hard disk, to be removed from or installed into the computer system while the computer remains operational. During "hot swapping", an operator may continue to work with the computer because the computer power unit remains turned on, the keyboard is functional, and even the screen continues to display information.

To facilitate "hot swapping" of storage devices, computers have been developed which include equipment "slides." Each slide is capable of "hot swapping" memory storage devices. A memory storage device mounts on a "carrier" which installs into a slide. The carrier provides a mechanical mounting to align and interconnect an electrical connector of the slide with an electrical connector of the carrier. A typical carrier is described in U.S. Pat. No. 5,269,698 issued Dec. 14, 1993 to Singer.

The Singer patent discloses a carrier which includes a lever having a latch for locking and releasing the carrier with the slide. When the lever is actuated, the latch applies force against a pin of the slide at an oblique angle with respect to the carrier axis. This force of the latch skews the carrier from alignment along the carrier axis. Mating electrical connectors (on the slide and the carrier respectively) misalign and become prone to damage. After such repeated use, the connectors are likely to fail.

In the Singer patent, the electrical connector of the carrier is not rigidly supported from the rear face of the electrical connector. Repeated misalignment and the lack of optimal support for the electrical connector stresses the electrical connector. Such stress is likely to cause mechanical failure of the electrical connector. To prevent connector failure, the mating electrical connectors are frequently replaced. To extend connector life, rugged connector designs are employed. Frequent replacement of connectors is time consuming. The costs of downtime, and the cost of hiring a technician are undesirable. Rugged connectors are bulky and expensive.

What is needed is a carrier which installs in precise alignment with an equipment slide to discourage such connector failure. A carrier is desired which optimally supports the electrical connector. A carrier is desired which is easy and inexpensive to manufacture, which does not pull to one side during insertion and locking, and which does not require the use of rugged and expensive connectors.

SUMMARY AND OBJECTS OF THE INVENTION

Various objects of the present invention are provided for the purpose of facilitating a better understanding of the present invention. The various objects are not to be read in any way which limits the scope of the appended claims.

It is an object of this invention to provide a carrier which precisely aligns and interconnects a memory storage device with an equipment slide of a computer.

It is an additional object of this invention to provide a carrier which does not pull to one side while being installed or removed.

It is an additional object of this invention to provide a carrier in which misalignment is minimized, the connector life is maximized, the likelihood of malfunction is reduced, and the reliability is increased.

In accordance with the above objects and those that will be mentioned and will become apparent below, a bracket assembly is provided which mates with an equipment slide having a pin, the bracket assembly comprising:

a carrier;

a cam mounted on the carrier at a first center of rotation, the first center of rotation being fixed on the carrier, the cam being formed with a cam hook having a curve which engages the pin of the equipment slide to translate the carrier relative to the equipment slide along a central axis of the carrier when the cam rotates; and a cam rotator mounted on the carrier and engaged with the cam, whereby the cam rotator rotates the cam to move the carrier relative to the equipment slide.

In a preferred embodiment, the cam hook is formed having a forward edge and a rear edge. The forward edge has a curved shape which corresponds with a curved shape of the rear edge. The forward edge urges against the pin to draw the carrier and the equipment slide together when the cam rotates in a first direction. The rear edge urges against the pin and separates the carrier and the equipment slide when the cam rotates in a second direction.

In another preferred embodiment of the present invention, the cam hook includes a curved shape having a non-uniform radius of curvature. An advantage of the curved shape of the cam hook is that movement of the carrier into the equipment slide is regulated by rotation of the cam hook. The carrier and the equipment slide are drawn together in alignment at a desire rate.

In another preferred embodiment, the cam rotator is a cam lever. The cam includes gear teeth which mate with gear teeth formed of the cam lever. Actuation of the cam lever by an operator rotates the cam about an axis of rotation, causing the cam to engage the centered pin. The actuation of the cam lever urges the cam hook against the pin to move the carrier in a direction along the central axis.

An advantage of movement of the carrier along the central axis is that the carrier is pulled into and out of the equipment slide without skewing to one side or the other. Wear and the likelihood of damage to the mating connectors caused by misalignment during insertion and extraction is reduced.

In another preferred embodiment, the mating connector of the bracket assembly is mounted on a connector alignment member. The electrical connector includes a rear face supported by a connector brace. The electrical connector is thereby protected from damage during repeated insertions and extractions with the electrical connector of the equipment slide.

An advantage of supporting the rear face of an electrical connector by the support member is that a relatively less rugged electrical connector may be employed. Connector life is extended. The likelihood of connector damage is reduced.

BRIEF DESCRIPTION OF THE DRAWINGS

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
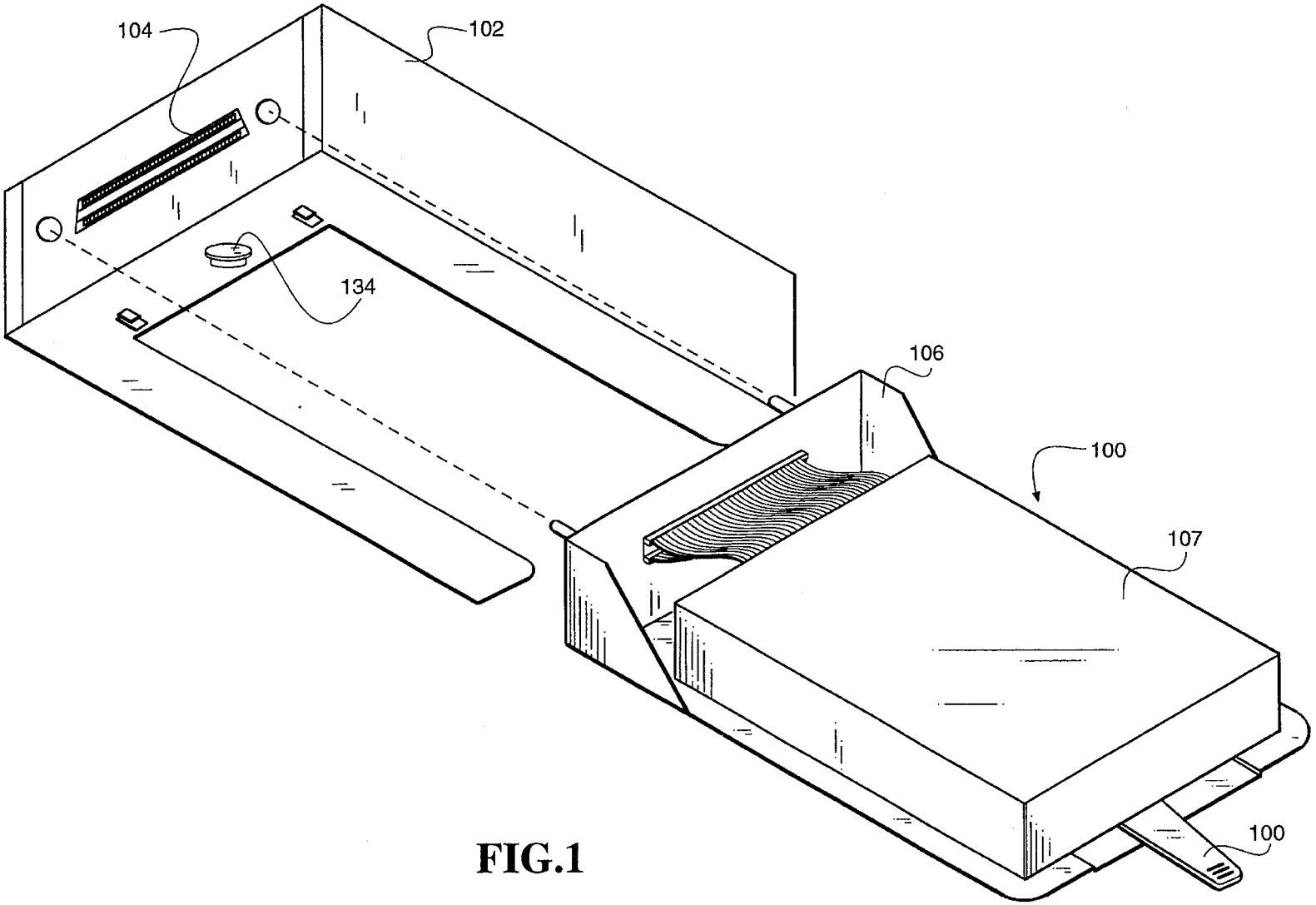
FIG. 1 is a perspective view of a bracket assembly aligned with an equipment slide in accordance with the present invention.

FIG. 1 shows a bracket assembly generally designated with the reference numeral 100 in accordance with the present invention. The bracket assembly 100 is positioned with an equipment slide 102. The bracket assembly 100 includes a carrier 106 which holds a memory storage device 107, and a cam lever 110. The cam lever 110 is actuated by an operator to lock the carrier 106 with the pin 134 of the carrier 106.

Figure 2:
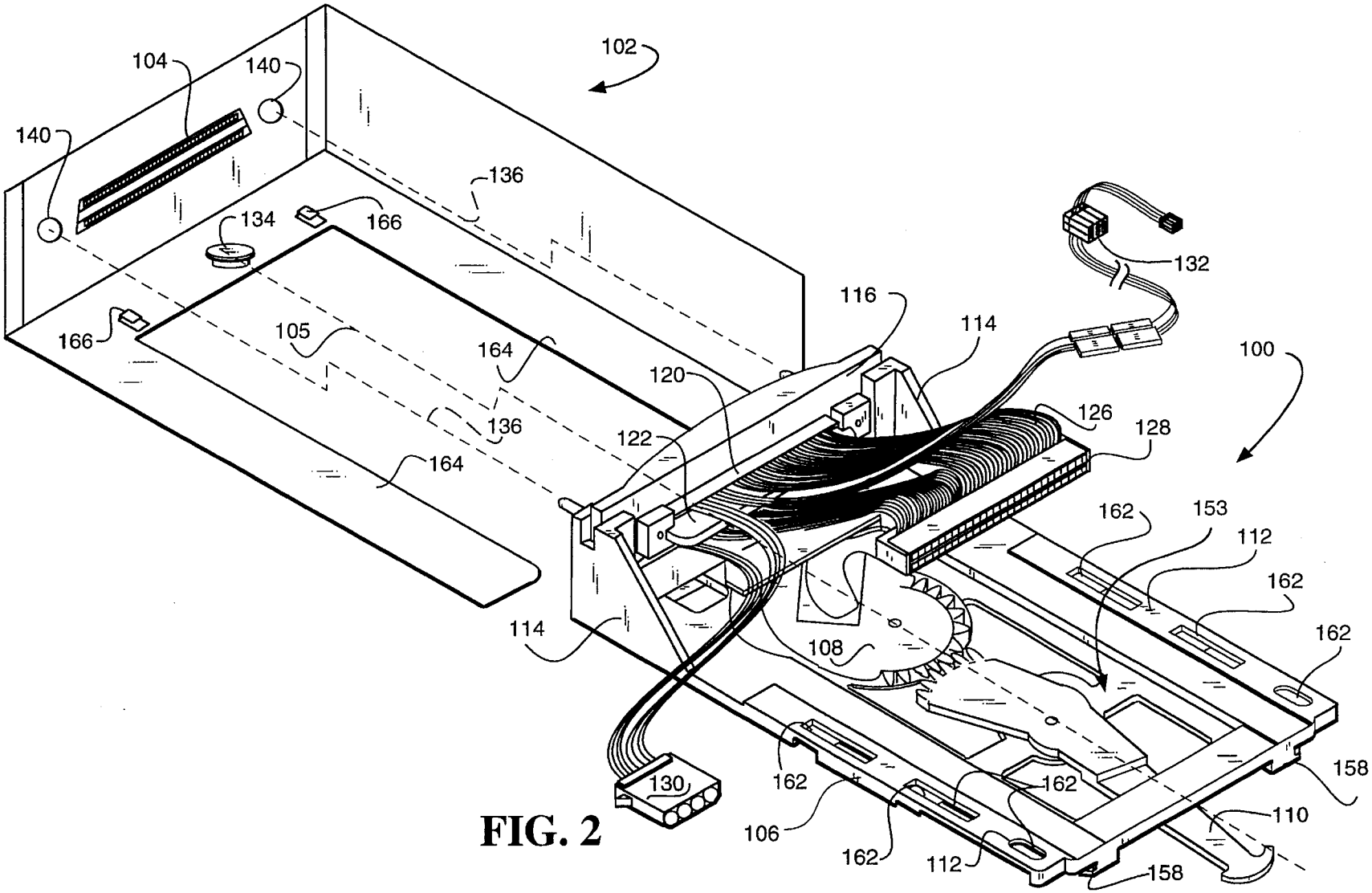
FIG. 2 is a perspective view of a bracket assembly which is aligned with an equipment slide in accordance with the present invention.

FIG. 2 shows the bracket assembly 100 of FIG. 1 in accordance with the present invention with the memory storage device 107 removed. The bracket assembly 100 mates with an equipment slide 102 of a computer having a electrical connector 104 and a pin 134. The bracket assembly 100 includes, a carrier 106, a cam 108, a cam lever 110 and a central axis 105. The carrier 106 includes, a pair of support guides 114, a connector alignment member 116, a connector brace 122 and an electrical connector 120.

The pair of support guides 114 mount on the bracket assembly 100 and hold the electrical connector 120. The support guides 114 each extend perpendicularly out from the carrier 106 at the connection end 160 of the carrier 106. The connector alignment member 116 mounts on the support guides 114 and includes an opening 118 (see FIG. 3).

Insertion path

The bracket assembly 100 inserts into the equipment slide 102. A pair of grooves 158 of the bracket assembly engage the slides 164 respectively of the equipment mount 102. The grooves 158 cooperate with the cam hook 108 to align the bracket assembly 100 in the equipment mount 102. The broken lines 136 are parallel with the central axis 105 and show a path, along which, the bracket assembly 100 moves into, or out from the equipment slide 102.

Wiring

Control lines, data signal lines and power lines from a computer connect with the electrical connector 104 of the equipment slide 102. The electrical connector 120 interconnects a memory storage device (e.g. the hard disk drive 107) with the electrical connector 104 of the equipment slide 102 via the wiring harness 126. The wiring harness 126 includes a plurality of wires and various plugs 128, 130 and 132. The bracket assembly 100 can be adapted with an appropriate wiring harness 126 to accommodate a variety of memory storage devices. The actual appearance and number of the plurality of wires and the plugs 128, 130, and 132 will depend upon the requirements of the specific memory storage device used.

Figure 3:
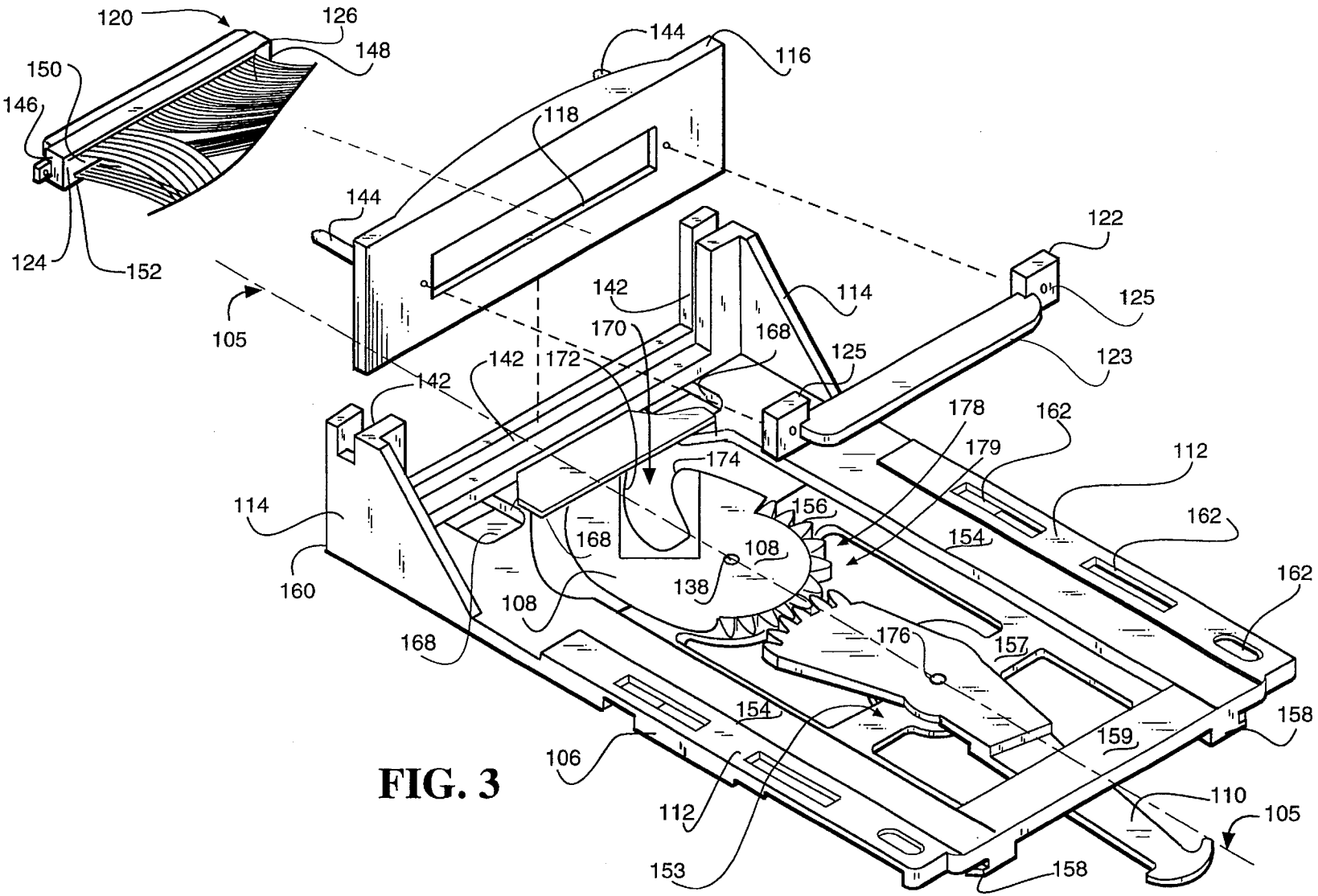
FIG. 3 is a partially exploded perspective view of the bracket assembly shown in FIG. 2 in accordance with the present invention.

FIG. 3 shows a vertical slot 142 is defined between the support guides 114 at the end 160 of the carrier 106. The slot 142 receives the connector alignment member 116 and removably holds the connector alignment member 116 in a press fit.

Opening

An opening 118 is defined as a rectangular hole on the connector alignment member 116. The opening 118 is formed having a shape and size to almost coincide with the shape and size of the electrical connector 120. More specifically, the opening 118 is slightly larger than the rear face 124 of the electrical connector 120. When the electrical connector 120 connects with the connector alignment member 116, the rear face 124 extends through the opening 118.

Connector Brace

The connector brace 122 mounts on the connector alignment member 116 over the opening 118. The connector brace 122 has a flat body 123 and a pair of mounts 125 at each of two ends of the flat body 123. The flat body 123 of the connector brace 122 extends between mounts 125 in a plane perpendicular to the connector alignment member 116. The mounts 125 meet with opposing ends 146 and 148 respectively of the electrical connector 120. The mounts 125 permit fasteners such as screws to secure the connector brace 122, the connector alignment member 116 and the electrical connector 120 together.

The connector brace 122 holds and aligns the electrical connector 120 in the opening 118. The electrical connector 120 aligns relative to the central axis 105 to optimally align and protect the electrical connector 120 from damage or deformation during repeated insertion and removal of the bracket assembly 100 from the equipment slide 102.

Electrical Connector

The electrical connector 120 includes a plurality of wires in a wiring harness 126. A portion of the wires extend through the opening 118 of the connector alignment member 116 above the connector brace 122 and a second portion of the wires extend through the opening 118 of the connector alignment member 116 below the connector brace 122.

For the purposes of the present invention, a wide range of electrical connectors may be used. Alternate electrical connectors which do not conform exactly in shape can be adapted by a housing, for example, so that the alternate electrical connector can be firmly held in the opening 118.

FIGS. 2 and 3 together show the connection of the electrical connector 120 with the carrier 106. Wires of the wiring harness 126 which emerge from the rear face 124 of the electrical connector 120 in two parallel rows 150, 152. The two rows of wires 150 and 152 are slightly spaced apart and permit the connector brace 122 to fit across the rear face 124 and between the two rows 150, 152. Accordingly, the two rows of wires 150 and 152 extend respectively above and below the flat body 123 of the connector brace 122. Preferably, the electrical connector 120 includes an AMP 80-pin Micro Centronics, panel mount connector.

Alignment Pins

The bracket assembly 100 includes a pair of alignment pins 144. The pair of alignment pins 144 are generally cylindrical shaped have tapered ends extend from the connector the pair support guides 114 respectively to align the electrical connector 120 with the electrical connector 104 of the equipment slide 102. The alignment pins 144 align and respectively engage with a pair of alignment openings 140 of the equipment slide 102.

Recesses

The bracket assembly 100 includes a pair of recesses 168. The pair of recesses 168 are located near the end 160 of the carrier 106. The pair of recess 168 engage a pair of vertical tensioners 166 of the equipment slide 102 (see FIG. 2). The recesses 168 and the vertical tensioners 166 cooperate to guide and hold the bracket assembly 100 in a mating position with the equipment slide 102. This cooperation of structure reduces shock and vibration between mating parts, limits the insertion distance to protect the connectors 104 and 120.

Rails, Bridge and Platforms

The carrier includes a pair of rails 154, a bridge 153 and a pair of platforms 112. The bridge 153 includes several spans 156, 157 and 159. The pair of rails 154 align with the central axis 105 and join with a bridge 153 to form a composite structure.

The platforms 112 mount on the rails 154 respectively, and align parallel with the central axis 105. The platforms 112, more particularly, extend above the outer edges of the rails 154 respectively. A plurality of holes 162 in the platforms 112 permit mounting of a memory storage device. Suitable memory devices include, but are not limited to, a floppy disk drive, a magnetic tape drive, an optical data storage unit and a hard disk drive.

Cam

Figure 4:
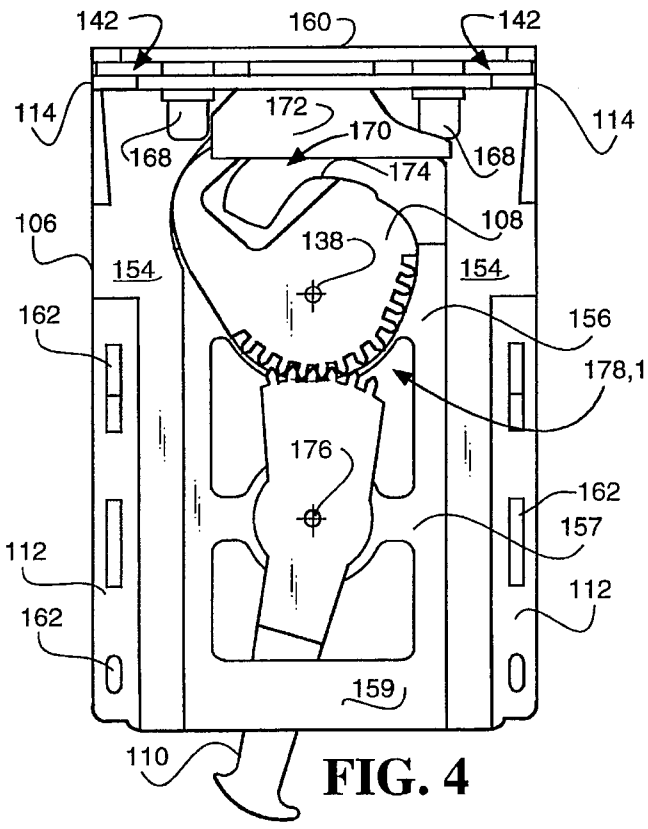
FIG. 4 is a top view of the bracket assembly of FIG. 3 in accordance with the present invention.

FIG. 4 shows a top view of the carrier 106 depicted in FIG. 3. The cam 108 includes a cam hook which is generally designated with the reference numeral 170, a center of rotation 138, a recessed portion 175, a geared portion generally designated by the reference numeral 178, gear teeth 208, and a spring 180 (see FIG. 5).

The cam 108 is flat and includes a recessed portion 175 which surrounds the cam hook 170. The cam 108 mounts on the carrier 106 at the center of rotation 138. The center of rotation 138 is fixed along a central axis 105 of the carrier 106 at the span 156 of the bridge 153. The geared portion 179 of the cam 108 includes a plurality of gear teeth 208.

Figure 5:
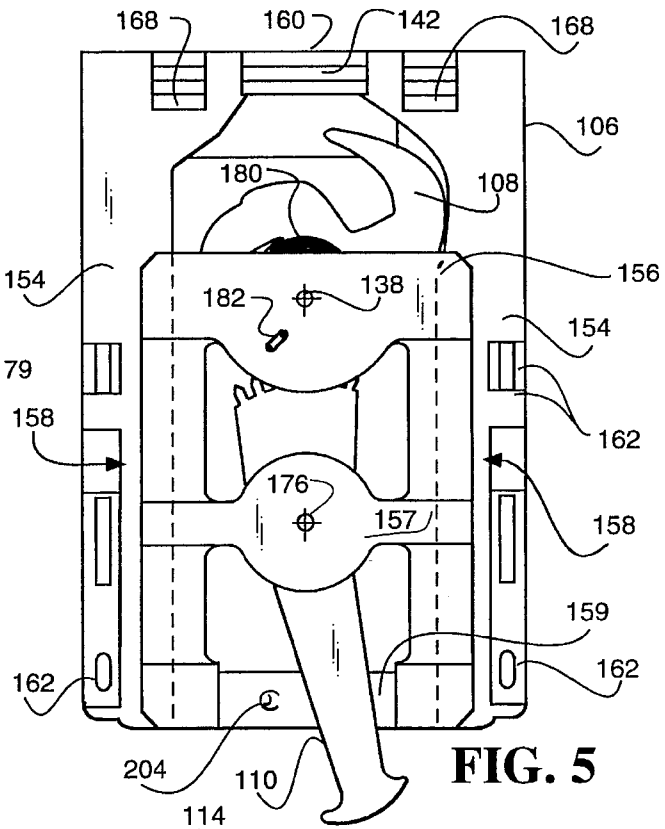
FIG. 5 is a bottom view of the bracket assembly of FIG. 3 in accordance with the present invention.

FIG. 5 shows a bottom view of the carrier 106. A portion of the spring 180 is shown having one end extending through a hole 182 in the span 156. The other end of the spring 180 attaches to the underside of the cam 108. The spring 180 mounts on the span 156 of the carrier 106 about the center of rotation 138 to bias the cam 108 into an unlocked position. The cam 108 is shown in detail in FIG. 8.

Cam Hook

The cam hook 170 is formed integral with the cam 108. The cam hook 170 is configured having a forward edge 172 and a rear edge 174. The cam hook 170 has a curved shape designed to precisely align the bracket assembly 100 with the equipment slide 120. The forward edge 172 has a curved shape which corresponds with the curved shape of the rear edge 174. The cam hook 170 engages with the pin 134 of the equipment slide 102, and engages the cam lever 110.

In an embodiment of the cam hook 170, the cam hook 170 is formed having a curved shape having a non-uniform radius of curvature. As can be appreciated, the cam hook 170 may be formed having various curved shapes, such as those having a uniform radius of curvature having a center of curvature which does coincide with the center of rotation 138 of the cam 108. The curvature of the cam hook 170 is formed to achieve desired movement, and a desired rate of movement of the carrier 106 with respect to the equipment slide.

The cam 108 is reciprocally rotatable so the forward edge 172 of the cam hook 170 urges against the pin 134 of the equipment slide 102 to draw the carrier 106 and the equipment slide 102 together when the cam 108 rotates in a first direction. The rear edge 174 urges against the pin 134 and separates the carrier 106 and the equipment slide 102 when the cam 108 rotates in a second direction.

Figure 6:
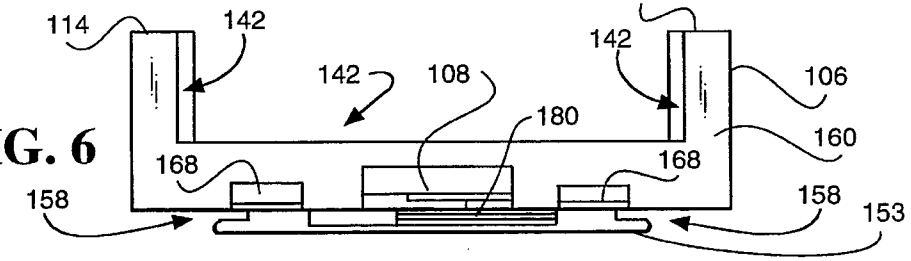
FIG. 6 is a side view of the bracket assembly of FIG. 3 in accordance with the present invention.

FIG. 6 shows a side view of the carrier 106 of FIG. 3. A pair of grooves, generally designated 158 are engagable with the slides 164 of the equipment slide 102. A pair of vertical tensioner recesses 168 are shown which are engagable with the vertical tensioners 166.

Cam Rotator

The cam rotator is a cam lever 110 which includes the geared portion 179, gear teeth 208, a center of rotation 176, a lock 200 and a grip 220. The cam lever 110 mounts on the carrier 106 at the center of rotation 176 to interconnect with and actuate the cam 108. The geared portion 179 of the cam lever 110 mates with a geared portion 178 of the cam 108 so that the gear teeth 208 of the cam lever 110 engage the gear teeth 206 of the cam 108.

The center of rotation 176 of the cam lever 110 is affixed to the bridge 153 on the span 157. The cam lever 110 mounts on the span 157 to rotate about the center of rotation 176. The center of rotation 138 of the cam 108 and the center of rotation 176 of the cam lever 110 are centered between the rails 154 along the axis 105. The cam lever 110 is formed having a length. The length extends from the cam 108 to regulate the rate at which cam 108 rotates and to regulate the rate at which the carrier 106 moves relative to the equipment slide 102.

Although a particular cam rotator which is a cam lever 110 is known to be effective as disclosed, it will be appreciated that a variety of cam rotators may be employed in accordance with the present invention. For example, a cam rotator which actuates electrically, or relies on various mechanical movements caused by an operator, may be employed within the spirit and scope of this invention.

Lock

Figure 7:
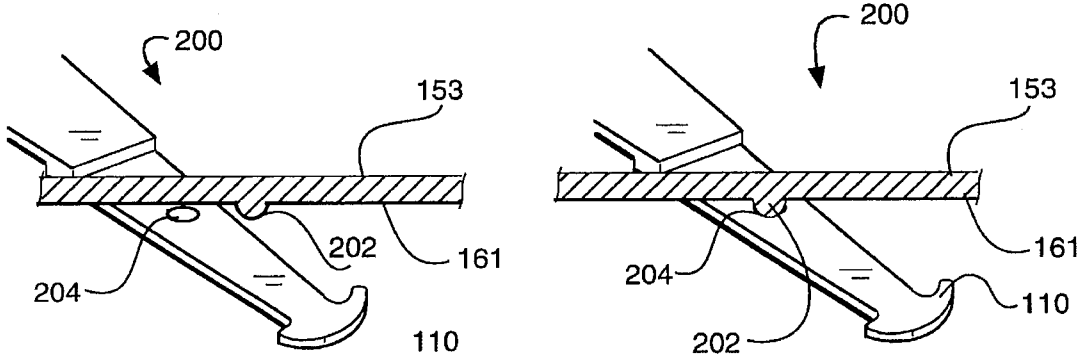
FIG. 7 is a perspective view of the cam rotator shown in FIG. 3 in accordance with the present invention. From left to right, the cam rotator is shown in an unlocked position and a locked position respectively.

FIG. 7 shows a lock which is generally designated with the reference numeral 200 in an unlocked and a locked position (left to right, respectively). The lock 200 attaches to the carrier 106 at span 159 and engages the cam lever 110 when the cam lever moves from an unlocked position to a locked position. The lock 200 holds the cam lever 110 in a locked position to prevent movement of the cam 108. Thus, the lock 200 simultaneously locks the cam lever 110 and the cam 108 in a locked position.

The lock 200 includes a locking member 202 extending from the carrier 106. The locking member 202 engages with a detent 204 formed on the cam lever 110.

Figure 8:
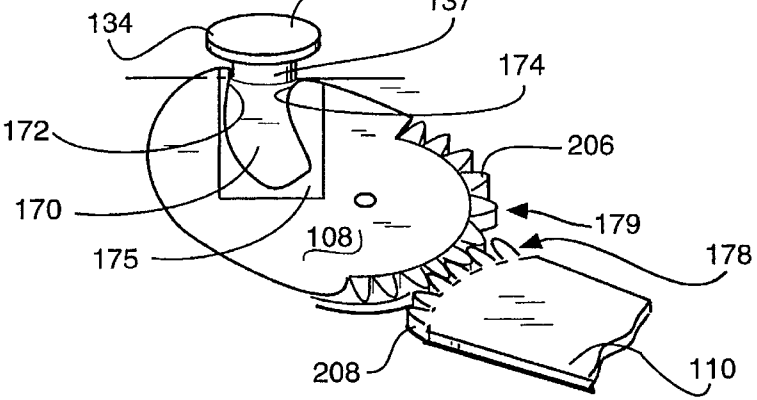
FIG. 8 is a perspective view of a cam rotator and a cam associated with a pin of an equipment slide as shown in FIG. 2 in accordance with the present invention.

FIG. 8 shows the pin 134 of the equipment slide 102 and the cam 108 of FIG. 2 in a perspective view. The pin 134 includes a flattened head 135 and a stem 137. When cam hook 170 engages the pin 134, the forward edge 172 urges against the stem 137 in a direction toward the bracket assembly 100 along the axis 105. The recessed portion 175 receives the flattened head 135 of the pin 134. The recessed portion 175 smoothly guides the cam 108 with the pin 134. Accordingly, the cam hook 170 engages the pin 134 of the equipment slide 102 to apply force against the pin in a direction along the central axis when cam rotates.

Figure 9:
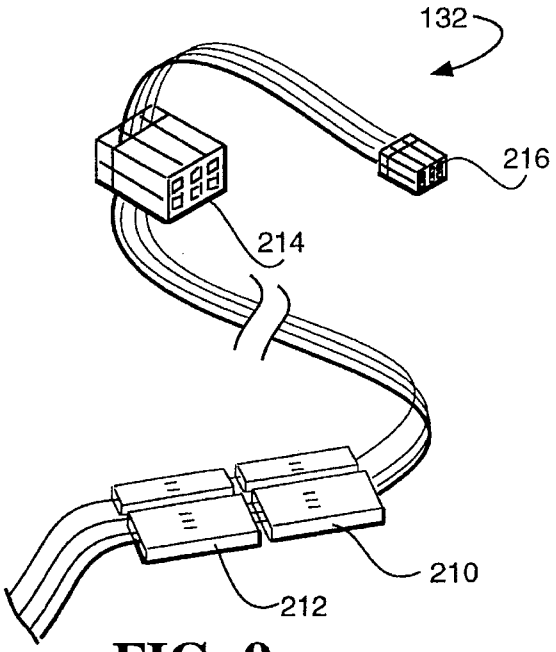
FIG. 9 is a perspective view of the plug of FIG. 2 in accordance with the present invention.

In FIG. 9 the plug 132 of FIG. 2 is shown. The plug 132 includes a first end 210 which attaches to an end 212 of the wiring harness 126. Plug 132 includes a first adaptor 214 and a second adaptor 216. Each of the adaptors 214 and 216 are formed to interconnect with a particular disk drive. Accordingly, when a disk drive is switched to an alternate disk drive, plug 216 includes an appropriate adaptor for interconnection with the alternate disk drive. Thus, plug 132 is connectable with a variety of disk drives.

Figure 10:
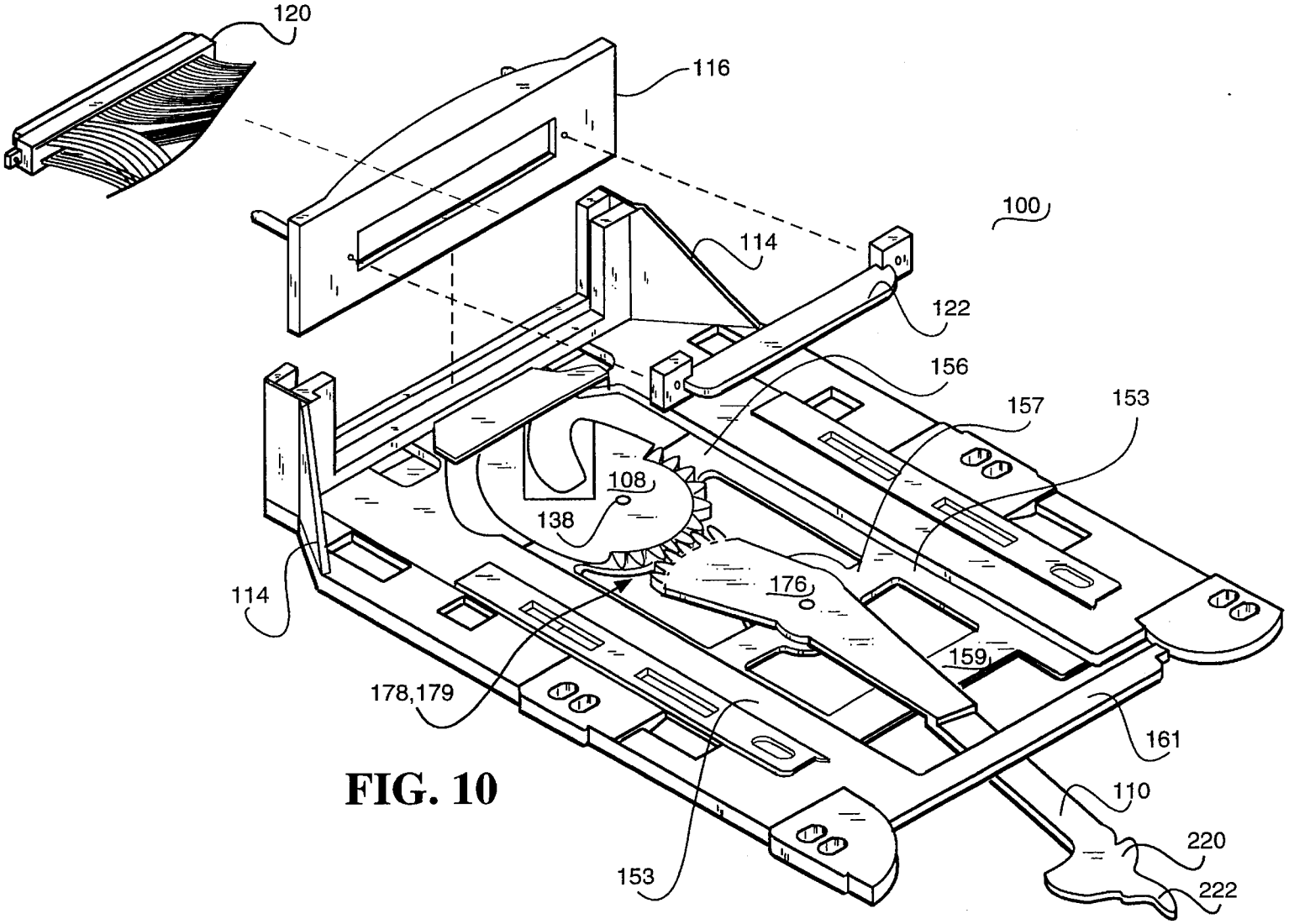
FIG. 10 is a perspective view of another preferred embodiment of the present invention.

FIG. 10 shows an embodiment of the present invention where the cam lever 110 includes a grip 220 having an extension 222. The lock 200 mounts under the span 161 of bridge 153. The span 159 biases the cam lever 110 against the span 161 to insure proper operation of the lock 200. The support guides 114, the support guides are tapered outward to accommodate a connection between a bracket assembly 100 of a large size and an equipment slide 102.

In Operation

Figure 11:
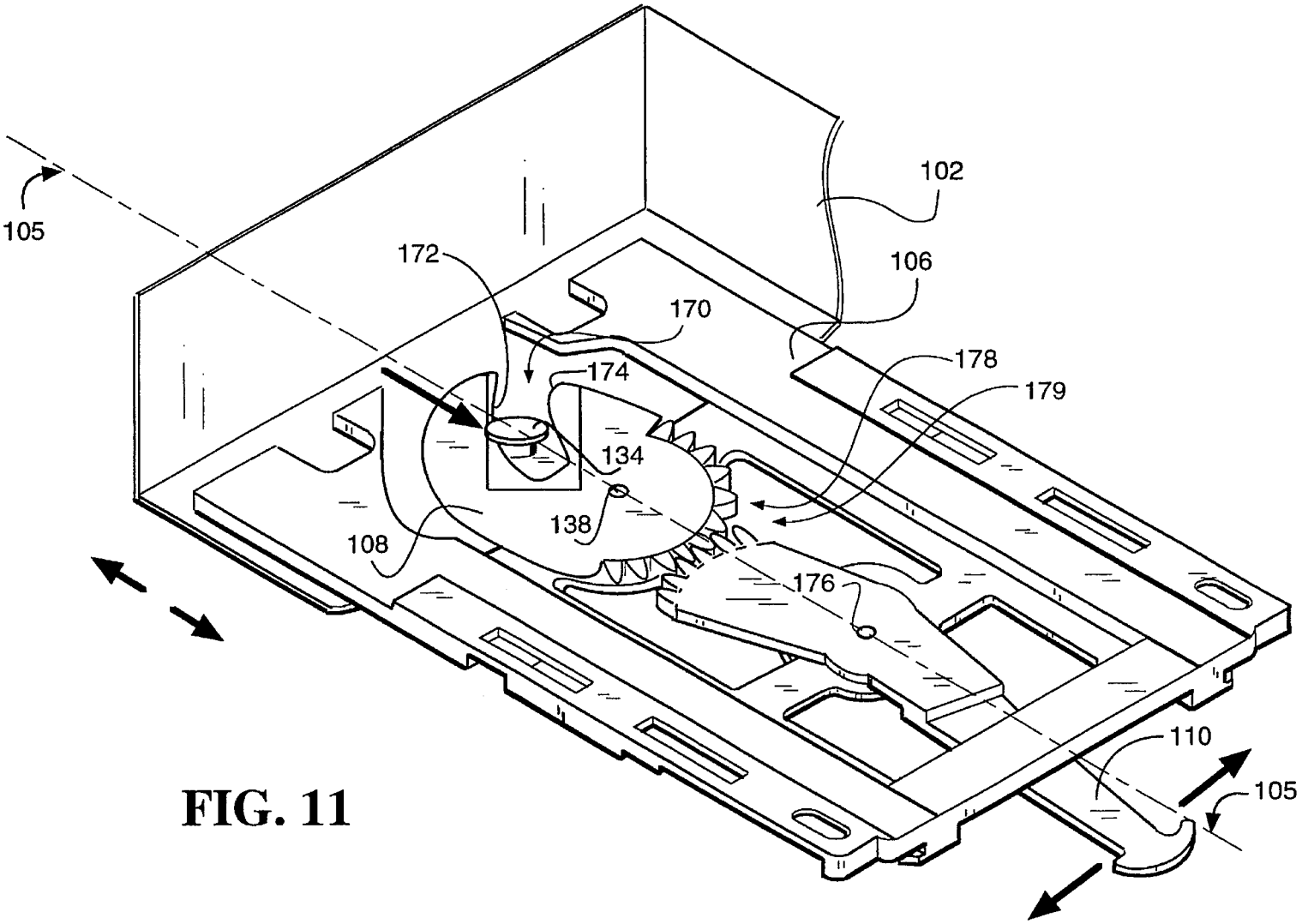
FIG. 11 is a perspective view of the carrier of FIG. 3 in operative connection with an equipment slide in accordance with the present invention.

FIG. 11 shows the carrier 106 mating with the equipment slide 102. Arrows indicate movement of the cam lever 110. In response to movement of the cam lever 110, force is applied to the pin 134 in a direction along the axis 105. As shown by the arrow pointed toward the pin 134, force may be applied against the pin 134 to draw the carrier 106 toward the equipment slide 102. It can be appreciated that by reciprocal motion of the cam lever 110 that force will be applied to the pin 130 to urge the carrier out from the equipment slide 102.

As the bracket assembly 100 is manually inserted into the equipment slide 102, the pin 134 meets the rear edge 174 of the cam hook 170. Actuation of the cam lever 110 by a user rotates the cam 108 and the leading edge 172 of the cam hook 170 urges against the pin 134. The geared portion 178 of the cam lever 110 meshes with the geared portion 179 of the cam 108.

The cam hook 170 is shaped such that the leading edge 172 draws the bracket assembly 100 further into the equipment slide 102 as the cam 108 rotates until the connectors 120 and 104 mate. The vertical tensioners 166 prevent the bracket assembly 100 from moving too far into the slide 102 and thereby prevents connector damage. A snug fit between the bracket assembly 100 and the equipment slide 102 restrains the cam 108 and the spring 180 from restoring the cam 108 to an unlocked position. The lock 200 restrains the cam lever 110 and the cam 108 from moving from the locked position. Thus, the engagement of the cam 108 with the pin 134 locks the bracket assembly 100 in place.

When the bracket assembly 100 fully inserts into the equipment slide 102, the electrical connector 104 of the equipment slide 102 and the electrical connector 120 of the bracket assembly mate and electrically communicate.

The bracket assembly 100 releases from the equipment slide 102 by reciprocal actuation of the cam lever 110 to unlock the cam 108 from the pin 134 and thereby unlock the bracket assembly 100 from the equipment slide 102. When the cam lever 110 reciprocates to unlock the bracket assembly 100, the cam 108 rotates and urges the rear edge 174 of the cam 108 against the pin 134 to separate the electrical connector 104 from the electrical connector 120 and push the bracket assembly 100 in a direction along the central axis 105 out from the equipment slide 102.

The bracket assembly 100, the carrier 106, the cam 108, the cam lever 110, the connector alignment members 116 and the connector braces 122 are all made of a hard, molded plastic. Accordingly, costs associated with metal carrier fabrication are eliminated. The heat resistivity of the plastic can be adapted as desired. The plastic is rigid and durable.

While the foregoing detailed description has described a preferred embodiment of the bracket assembly for installing and removing electrical devices to and from an equipment slide mounted in electrical equipment in accordance with this invention, it is to be understood that the above description is illustrative only and not limiting of the disclosed invention. The invention as disclosed is to be limited only by the claims as set forth below.

What is claimed is:

1. A bracket assembly for mating with an equipment slide, comprising:

a carrier having a first center of rotation and a second center of rotation;

a cam rotatably mounted on the carrier at the first center of rotation, the cam having a cam hook which is engagable with the equipment slide; and a cam lever rotatably mounted on the carrier at the second center of rotation for rotating the cam, whereby when the cam lever rotates the cam, and the cam hook engages the equipment slide, the bracket assembly mates with equipment slide.

2. A bracket assembly for mating with an equipment slide, comprising:

a carrier having a first center of rotation;

a cam rotatably mounted on the carrier at the first center of rotation, the cam having gear teeth and a cam hook which is adapted for engaging the equipment slide; and a cam lever moveably mounted on the carrier, the cam lever including gear teeth which are adapted for mating with the gear teeth of the cam lever, whereby, when the cam hook engages the equipment slide and the gear teeth of the cam lever mate with the gear teeth of the cam lever, movement of the cam lever causes the bracket assembly to mate with the equipment slide.

3. A bracket assembly as set forth in claim 2, wherein the equipment slide includes a first electrical connector and wherein, the bracket assembly includes a second electrical connector being adapted for mating with the first electrical connector; a connector alignment member mounted on the carrier; and a connector brace mounted on the connector alignment member to hold the second electrical connector.

4. A bracket assembly as set forth in claim 3, wherein the carrier includes a pair of support guides mounted on the carrier; the pair of support guides define several slots for receiving the connector alignment member and removably holding the connector alignment member in a press fit in the slots.

5. A bracket assembly as set forth in claim 3, wherein the second electrical connector includes a plurality of wires, a first portion of the plurality of wires extend through the connector alignment member above the connector brace, a second portion of the wires extend through the connector alignment member below the connector brace.

6. A bracket assembly for interconnecting electronic devices mates with an equipment slide of a computer having a first electrical connector and a pin, the bracket assembly comprises:

a carrier;

a cam being rotatable about a first center of rotation, the first center of rotation being fixed on a central axis of the carrier, the cam being formed with a cam hook adapted with a curved shape for engaging the pin of the equipment slide to move the carrier along the central axis when the cam rotates and to align the carrier with respect to the equipment slide;

a cam lever mounted on the carrier, the cam lever engages the cam;

a lock mounted on the carrier, the lock engages with the cam lever to lock the carrier with the equipment slide; and a second electrical connector mounted on the carrier, the second electrical connector being connectable with the first electrical connector, wherein the first center of rotation and the pin align along the central axis and the cam draws the bracket assembly along the central axis in response to actuation of the cam lever.

7. A bracket assembly as set forth in claim 6, wherein a spring is mounted on the carrier about the center of rotation and engages the cam to bias the cam lever into an unlocked position.

8. A bracket assembly as set forth in claim 6, wherein the cam lever includes grip having an extension to permit an operator to simultaneously hold the extension and the equipment slide and apply force to the extension in a direction perpendicular to the central axis.

9. A bracket assembly as set forth in claim 6, wherein the second electrical connector includes a plurality of wires, a first portion of the wires extend through the connector alignment member above the connector brace and a second portion of the wires extend through the connector alignment member below the connector brace.

10. A bracket assembly as set forth in claim 6 further comprising:

a plug electronically connected with the electrical connector, the plug includes a first end attached to an end of a wiring harness included with the electrical connector, the plug includes a first adaptor and a second adaptor, each adaptor being formed to interconnect with a particular disk drive.

11. A bracket assembly as set forth in claim 6, wherein the lock is a locking member extending from a bridge formed on the carrier, the locking member being engagable with a recess defined on the cam lever.

12. A bracket assembly as set forth in claim 11, wherein the cam lever includes a second center of rotation, the second center of rotation being fixed on the bridge along the central axis.

13. A bracket assembly as set forth in claim 6 further comprising:

a pair of support guides mounted on the carrier for holding the second electrical connector.

14. A bracket assembly as set forth in claim 13 further comprising:

a connector alignment member attached to the carrier and between the support guides; and a connector brace mounted on the connector alignment member to align the second electrical connector relative to the central axis to protect the second electrical connector from damage during installation and removal of the bracket assembly from the equipment slide.

15. A bracket assembly as set forth in claim 14, wherein several slots are defined by the pair of support guides for receiving the connector alignment member and removably holding the connector alignment member in a press fit in the slots.

* * * * *